United States Patent [19]

A'Costa

[11] Patent Number: 4,716,809

[45] Date of Patent: Jan. 5, 1988

[54] DEBRIS SHIELD/FLASH REDUCER

[76] Inventor: Anthony A'Costa, P.O. Box 5806, 710 W. 4th St., Pueblo, Colo. 81002

[21] Appl. No.: 804,891

[22] Filed: Dec. 5, 1985

[51] Int. Cl.[4] ..... F41F 17/12

[52] U.S. Cl. ..... 89/14.3; 42/96

[58] Field of Search ..... 89/14.05, 14.1, 14.2, 89/14.3, 14.4, 14.5, 14.6, 30; 42/75.01, 79, 96

[56] References Cited

U.S. PATENT DOCUMENTS

| | | | |
|---|---|---|---|
| 372,328 | 11/1887 | Pickett | 42/96 |
| 2,545,473 | 3/1951 | Kremkau | 42/96 |
| 3,063,184 | 11/1962 | Sukala | 42/96 |
| 3,354,569 | 11/1967 | Kassabian | 42/96 |

FOREIGN PATENT DOCUMENTS

| | | | |
|---|---|---|---|
| 1021270 | 2/1953 | France | 89/14.4 |
| 14973 | of 1915 | United Kingdom | 42/96 |

*Primary Examiner*—Stephen C. Bentley
*Assistant Examiner*—Stephen M. Johnson
*Attorney, Agent, or Firm*—Harold H. Dutton, Jr.

[57] ABSTRACT

A debris shield/flash reducer for use in conjunction with attachments mounted on the muzzle end of a firearm barrel comprising a body member having a partial cylindrical configuration, a length adapted to extend along the attachments and a radius slightly greater than the radius of the attachment; a radially inwardly directed flange integrally formed with the body member at each end thereof for positioning the debris shield on the attachment, and attachment encircling means secured to the body member for securing the debris shield on the attachment.

8 Claims, 8 Drawing Figures

DEBRIS SHIELD/FLASH REDUCER

This invention relates to a combined debris shield and flash reducer. More particularly, the invention relates to a debris shield/flash reducer which may be used in conjunction with flash suppressors as used on fire arms.

BACKGROUND AND OBJECTS

Firearms, and particularly rifles, often have various accessory devices mounted on the muzzle end of the barrel. Such devices may include flash suppressors, silencers, sights, etc. The function of flash suppressors is to reduce or eliminate the flash of light accompanying the discharge of the fire arm, and one such flash suppressor is disclosed in my prior U.S. patent application Ser. No. 613,180 filed May 23, 1984. Other such flash suppressors are also known in the prior art. One problem which has arisen with flash suppressors and similar such attachments is that when the user is firing from a prone position, i.e. laying on the ground, often dirt and or debris will be kicked up from the ground by the muzzle blast. Such debris may enter the slots in the flash suppressor. These slots are an important part of the flash suppressor, as explained in my prior application, but when debris is allowed to enter the slots and pass into the inner bore of the flash suppressor, various problems can be caused.

One of the more significant problems associated with debris entering the flash suppressor is that a loss of accuracy may result as the ballistics of the weapon can be deleteriously affected.

Additionally, some types of flash reducers are not as effective as others, and still permit some visible flash to emanate from the muzzle when the weapon is discharged. In some applications, this is a significant disadvantage.

Accordingly, a primary object to this invention is to provide a portable debris shield/flash reducer which may be used with attachments mounted on the muzzle end of a fire arm.

Still another object of this invention is to provide a debris shield/flash reducer which may also function as a flash reducer.

Still a further object of this invention is to provide a debris shield which is light weight, and easily removed or transferred from one weapon to another.

Still a further object of the invention is to provide a debris shield which may be positioned as desired around the circumference of the muzzle end of the weapon.

These and other objects and advantages will become apparent when considered in light of the following description and claims together with accompanying drawings.

DESCRIPTION OF THE INVENTION

The debris shield/flash reducer according to the present invention is formed in the shape of a semi-cylindrical member having flanges at each end thereof. The flanges are generally at right angle to the cylindrical surface of the debris shield, and preferably are integral with the cylindrical surface. The debris shield is of such a configuration as to fit over a flash suppressor, and cover approximately one-half of the circumference thereof. Restraining elements are provided which encircle the flash suppressor and engage the debris shield in order to retain the shield on the suppressor body which in turn is mounted on the end of the barrel of the fire arm.

In an alternate embodiment, the debris shield is made of two members, each of which is of a similar configuration, but each of which only has a single inwardly turned flange on one end thereof. The two pieces are then able to slide with respect to each other in order to accommodate flash suppressors of differing lengths. An upwardly and outwardiy turn tab on each of the two pieces of this embodiment provides a mounting arrangement for a screw which retains the two pieces in their relative positions, while permitting an adjustment of the overall length of the debris shield.

Preferably, the debris shield is made of sheet metal such that it will be of light weight, and may be easily attached to a rifle or removed for storage.

DESCRIPTION OF THE PREFERRED EMBODIMENTS

Figure 1:
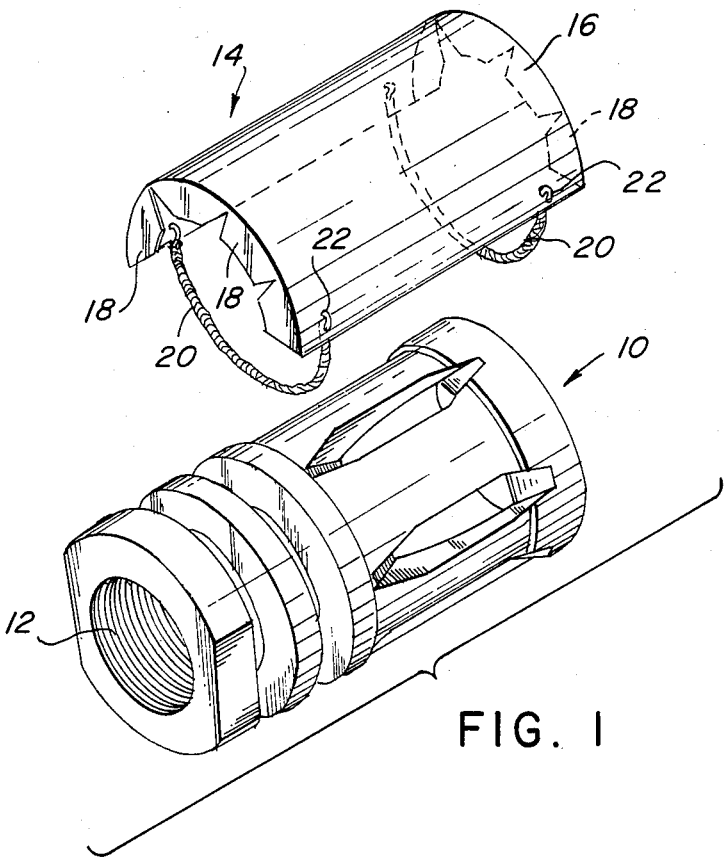
FIG. 1 is an exploded perspective view of a debris shield and flash suppressor.
Figure 2:
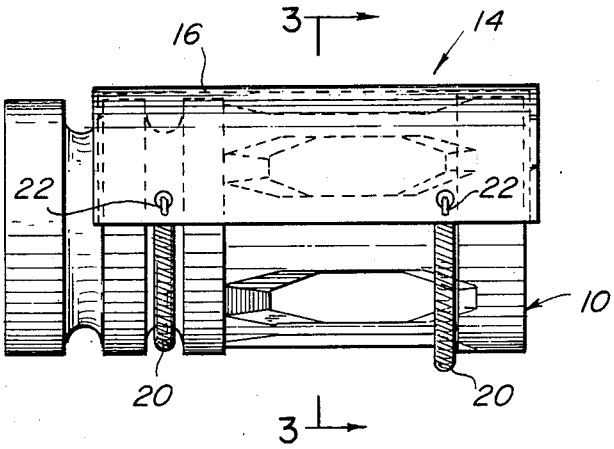
FIG. 2 is a side elevation view of a debris shield mounted on a flash suppressor.
Figure 3:
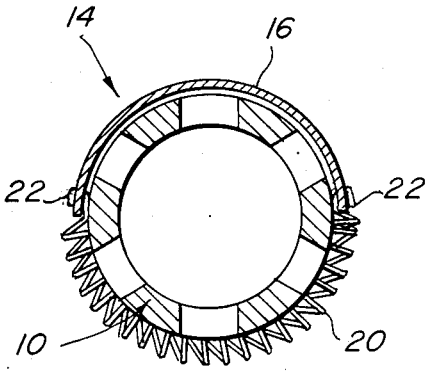
FIG. 3 is a cross sectional view along lines 3—3 of FIG. 2 and viewed in the direction of the arrows.

Referring now to FIGS. 1 to 3, a flash suppressor generally designated 10 is shown, and is of the type disclosed in my prior application Ser. No. 613,810. This flash suppressor is adapted to be attached to the threaded end of a rifle barrel by means of the threads 12 formed in the flash suppressor.

The debris shield generally designated 14 is seen to include a semi-cylindrical member 16 which is preferably formed of sheet metal or sheet steel. At each end of the member 16, a plurality of tabs 18 are provided, these tabs collectively forming a flange at each end of the member 16. A pair of elastic retaining elements such as springs 20 are provided with suitable hooks 22 on each end thereof, and the hooks 22 are adapted to engage openings in the member 16. The retaining members 20 may be coil springs as shown or other suitable elastic members, and are of such a length as to encircle the flash suppressor 10 and thereby secure the debris shield 14 in place thereon.

As seen in FIG. 2, the debris shield 16, when mounted on the flash suppressor 10, is positioned such that the flanges formed by the tabs 18 may rest in one of the annular grooves formed in the flash suppressor. The muzzle end of the debris shield which is also provided with tabs 18, is such that the flange formed at this end of the debris shield extends inwardly beyond the muzzle end of the flash suppressor 10.

When so positioned on the flash suppressor 10, the coil springs 20 encircle the flash suppressor 10 as seen, in order to secure the debris shield in place.

In this manner, the member 14 may be positioned in a manner most suitable for the use to which the fire arm is being put at a particular time. For example, if the shooter is laying prone, on the ground, the debris shield 16 may be rotated to the underside of the barrel, and will effectively prevent any dirt or debris which is kicked up by the muzzle blast from entering the slots in the flash suppressor.

Similarly, if it desired to prevent the muzzle blast from being seen from the right or left side of, or above the shooter, the debris shield may be rotated to either the right or left side or top of the flash suppressor in order to prevent the muzzle blast from being seen in the respective direction.

Figure 4:
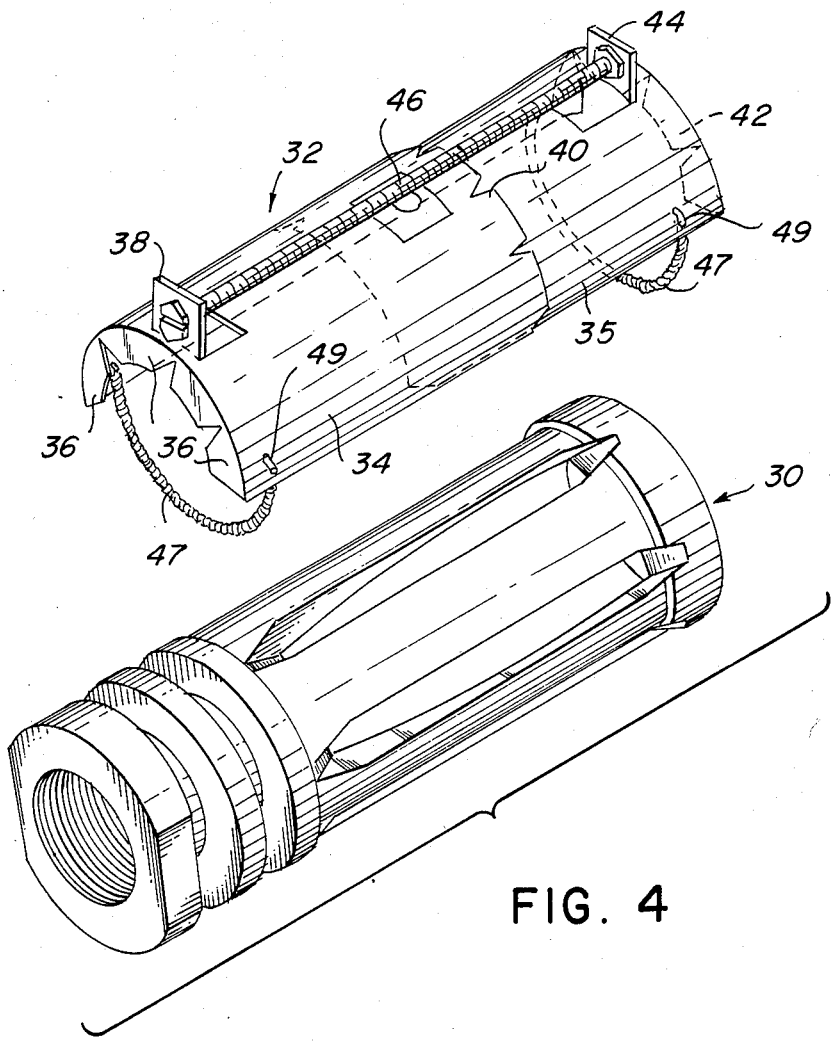
FIG. 4 is an exploded perspective view of another embodiment of a debris shield according to this invention.
Figure 5:
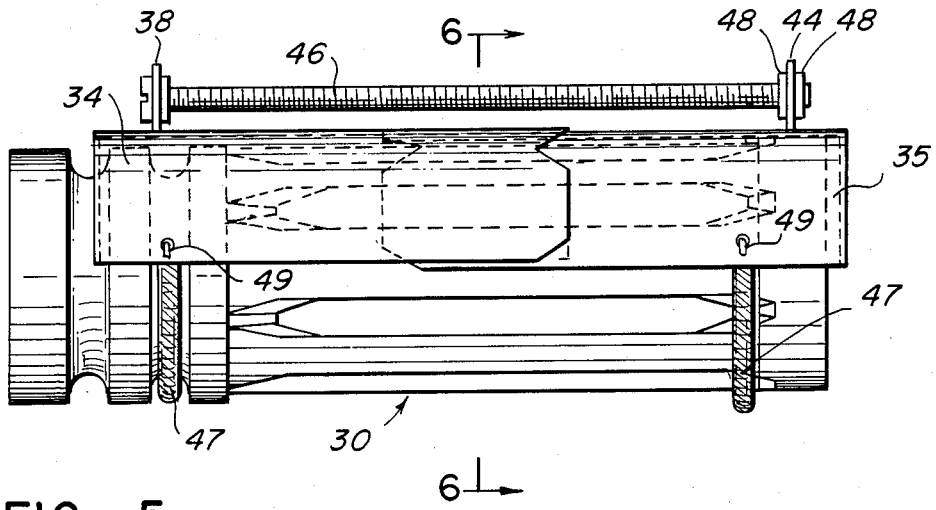
FIG. 5 is a side elevation view of the embodiment of FIG. 4, mounted on a flash suppressor.
Figure 6:
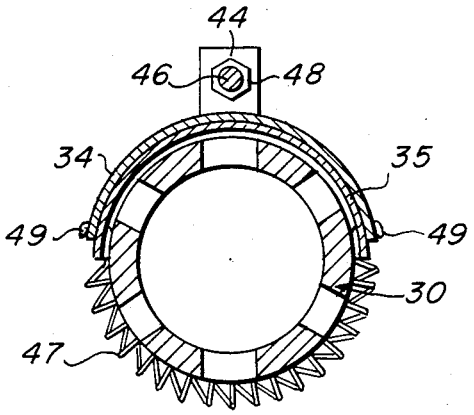
FIG. 6 is a sectional view along lines 6—6 of FIG. 5 and viewed in the direction of the arrows.

Referring now to FIGS. 4–6, an alternate embodiment of the invention is shown. The flash suppressor generally designated 30 is similar to flash suppressor 10, although the length may be different, depending upon the caliber of the weapon upon which it is used.

The debris shield 32 is seen to be a two piece, semicylindrical element formed from elements 34 and 36. The two sections 34 and 36 are essentially made the same, but turned 180° with respect to each other.

The element 34 has a plurality of radially inwardly turned tabs 36 which form a flange, and additionally includes an outwardly turned tab 38. Although the other end of the element 34 is also provided with tabs 40, these tabs are not bent inwardly as are the tabs 36.

The element 35, as mentioned above, is identical to the element 34, and is also provided with inwardly turned tabs 42. Further, an outwardly turned tab 44 is provided. A pair of elastic retaining elements 46 are provided with hook members 48, and the retaining elements 46 are adapted to encircle the flash suppressor 30 for retaining the shield 32 in place.

The outwardly turned tab elements 38 and 44 are provided with a central aperture, through which passes a connecting screw 46. The screw 46, serves to retain the two elements 34 and 35 in their relative positions on the debris shield, and this position may be adjusted by turning the screw into or out of nuts 48 which are positioned on opposite sides of one of the tabs 38 or 44. Thus, the length of the debris shield may be easily adjusted to accommodate flash suppressors as may be used on different calibers of weapons.

When the desired length is achieved as by turning the screw 46, the nuts 48 on opposite sides of the tab 44 may be tightened together by securing the screw 46 and the two elements 34 and 35 in their respective positions.

Figure 7:
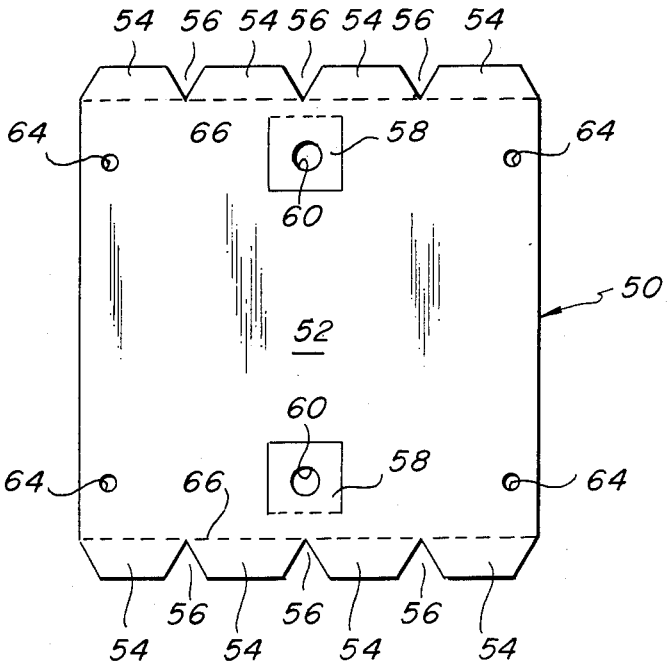
FIG. 7 is a top plan view of a blank from which the debris shield of FIGS. 4—6 may be formed.

FIG. 7 shows a blank generally designated 50, which may be used to form the elements 34 or 35. The blank comprises a generally rectangular configuration element 52, which is provided at opposite ends with a plurality of tabs 54, separated by V notches 56.

Also provided are a pair of tab cut-outs 58 with apertures 60, the tab cut-outs 58 being cut on three sides and remaining attached to the blank 52 along one side 62. In this manner the tab 58 may be bent upwardly to the positions shown in FIGS. 4–6. Similarly, the blank 52 is provided with a plurality of apertures 64 by means of which the attaching springs 46 may be secured in place.

Thus, by using two of the blanks shown in FIG. 7, and bending the tabs 54 along score lines 66, the debris shield of FIGS. 4–6 may be easily formed, even in the field. Thereafter, by assembly with a screw, the debris shield may be adjusted and adapted to a variety of different weapons.

Figure 8:
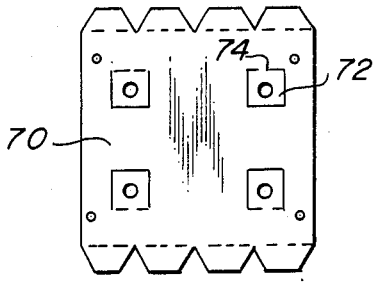
FIG. 8 is a top plan view of an alternate blank for use in forming a debris shield.

FIG. 8 shows an alternate embodiment of a blank, and in this case, the blank 70 is provided with four tab cut outs 72, again the cut outs 72 being attached along one side 74. In this manner, the blank will require the use of two screws to secure two semi-cylindrical elements in place, and this arrangement may be more suitable for larger caliber fire arms, or flash suppressors having a greater diameter.

While this invention has been described as having certain preferred features and embodiments, it will be understood that it is capable of still further modification and variation without departing from the spirit of the invention, and this application is intended to cover all variations, modifications, and adaptations which fall within the spirit of the invention and the scope of the appended claims.

I claim:

1. A debris shield/flash reducer for use in conjunction with attachments mounted on the muzzle end of a firearm barrel comprising a body member having a partial cylindrical configuration, a length adapted to extend along the attachments and a radius slightly greater than the radius of the attachment; radially inwardly directed flanges integrally formed with said body member at each end thereof for positioning said debris shield on the attachment and terminating radially outwardly of the bore of said attachment, and attachment encircling means secured to said body member for securing said debris shield on the attachment.

2. A debris shield as in claim 1 and wherein said attachment encircling means comprises elastic retaining means.

3. A debris shield as in claim 1 and wherein said body member comprises two body elements and means for securing said body elements in an adjustable, fixed relationship.

4. A debris shield as in claim 3 and wherein said body elements are identically configured and oppositely directed.

5. A debris shield as in claim 3 and wherein said securing means comprises upstanding tab means on each of said body elements, said tab means including an aperture for receiving a threaded securing member, and a threaded securing member extending through said tab means on each of said body elements.

6. A debris shield as in claim 5 and wherein said threaded securing member comprises a screw and a pair of retaining nuts on opposite sides of one of said tab means for tightening together against said one of said tab means.

7. A debris shield as in claim 6 and wherein said securing means comprising a pair of said upstanding tab means on at least one end of each of said body elements and two of said threaded securing members extending through said upstanding tab means.

8. A flash suppressor of the type adapted to be mounted on the end of a firearm barrel and including a debris shield mounted thereon, said debris shield comprising a body member having a partial cylindrical configuration, a length adapted to extend along said flash suppressor and a radius slightly greater than the radius of said flash suppressor; radially inwardly directed flanges integrally formed with said body at each end thereof for positioning said debris shield on said flash suppressor and terminating radially outwardly of the bore of said attachment, and flash suppressor encircling means secured to said body member for securing said debris shield on said flash suppressor.

* * * * *